United States Patent [19]

Chabot et al.

[11] Patent Number: 4,521,939

[45] Date of Patent: Jun. 11, 1985

[54] BELT BUCKLE

[76] Inventors: Carol Chabot; Ovila Chabot, both of 75 du Collège St., Pont-Rouge, Canada, G0A 2X0

[21] Appl. No.: 566,472

[22] Filed: Dec. 28, 1983

[51] Int. Cl.[3] ..... A44B 11/24

[52] U.S. Cl. ..... 24/188; 24/163 R; 24/163 K; 24/178; 224/163

[58] Field of Search ..... 24/188, 178, 163 R, 24/163 K, 179, 189, 190, 635; 224/163; 297/468; 292/302

[56] References Cited

U.S. PATENT DOCUMENTS

| | | | |
|---|---|---|---|
| 1,394,552 | 10/1921 | Hoeschen | 24/178 R |
| 1,478,659 | 12/1923 | King | 24/178 R |
| 1,525,424 | 2/1925 | King | 24/178 R |
| 2,339,297 | 1/1944 | Segal | 224/163 |
| 2,358,351 | 9/1944 | Segal | 24/178 R |
| 2,413,337 | 12/1946 | Segal | 24/163 R |
| 3,063,117 | 11/1962 | Rubin et al. | 24/178 R |
| 3,272,410 | 9/1966 | Reisman | 24/163 K |

FOREIGN PATENT DOCUMENTS

| | | | |
|---|---|---|---|
| 246956 | 12/1960 | Australia | 24/163 R |
| 1000396 | 2/1952 | France | 24/188 R |
| 2379996 | 10/1978 | France | 24/188 |
| 9650 | 8/1843 | United Kingdom | 24/178 R |
| 1142048 | 2/1969 | United Kingdom | 24/163 R |

*Primary Examiner*—Victor N. Sakran

[57] ABSTRACT

This belt buckle is characterized by having its belt-catching finger, or pin, arranged to also be used as a key or the like. A rigid flat sleeve has a dependent leg pivotally mounted on the transverse pin of the buckle to which one end of the belt is attached. The sleeve overlies the buckle. The flat head of the key is adjustably fixed within the sleeve. Keys, of various shapes, sizes and thicknesses, can be used. The belt-catching finger comprises a key-like main portion removably mounted within a T-shape casing, which is itself pivotally mounted on the frame of a belt buckle for its removal to cut key notches in a portion thereof, or to be replaced whenever desired.

1 Claim, 3 Drawing Figures

BELT BUCKLE

FIELD OF THE INVENTION

The present invention relates to a belt buckle the belt-catching finger of which is a lock key to be used as a spare key.

PRIOR ART

U.S. Pat. No. 3,063,117 dated Nov. 13, 1962 to S. Rubin & al, describes such a belt buckle. However, the key must be modified.

OBJECTS OF THE INVENTION

It is the specific object of the present invention to provide a belt buckle of the above type, the finger of which includes an ordinary key which need not be modified to be included therewith and which can use non-modified keys of various sizes, shapes and thicknesses.

DESCRIPTION OF A PREFERRED EMBODIMENT OF THE INVENTION

The above and other objects and advantages of the present invention will be better understood with reference to the following detailed description of a preferred embodiment which is illustrated, by way of example, in the accompanying drawings, in which.

Figure 1:
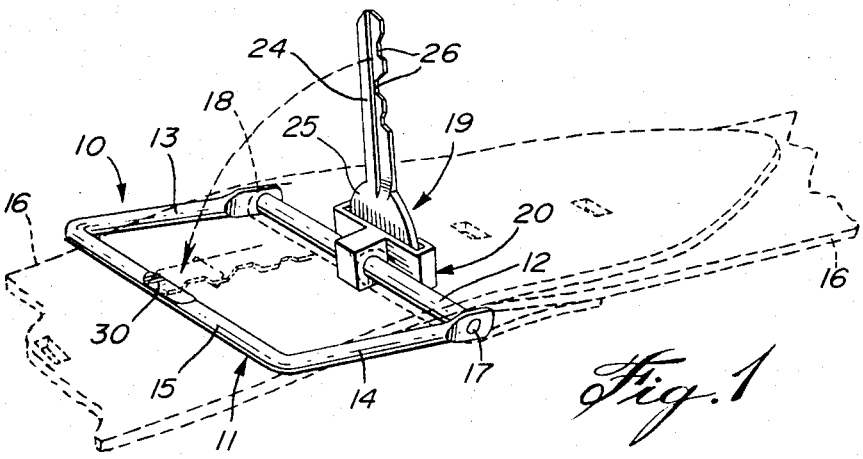
FIG. 1 is a perspective view of a belt buckle according to the present invention, and attached to a belt shown in dashed outline.
Figure 2:
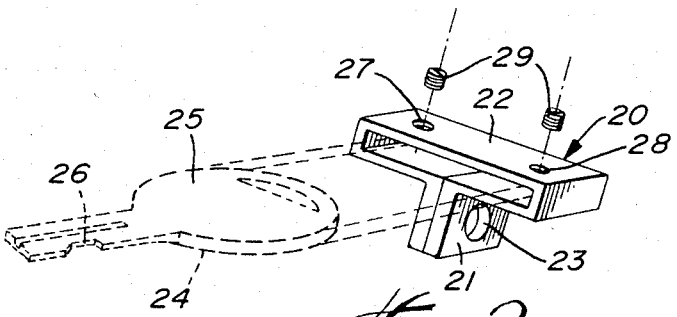
FIG. 2 is an exploded view of the key casing of FIG. 1, with the key shown in dotted lines.
Figure 3:
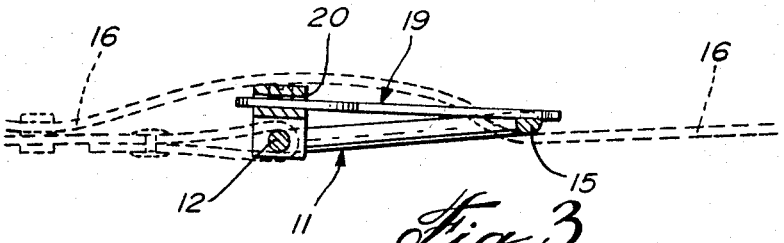
FIG. 3 is a longitudinal section of the same buckle as seen in belt-holding position.

The illustrated belt buckle comprises a frame 10 including a U-shape frame member 11 and a transverse pin 12. The U-shape frame member 11 includes opposite lateral portions 13, 14 and an intermediate transverse portion 15 which are of integral and rod-like construction. The opposite lateral portion 13, 14 operatively extend longitudinally of the belt 16 and buckle 10. The intermediate transverse portion 15 and transverse pin 12 operatively extend transversely of the belt 16 and form opposite transverse frame portions. One end of belt 10 is attached to pin 12 by being looped around the same.

The transverse pin 12 has two ends 17,18 wherein the pin may slide through the flat end of the end portions 13 and 14 to carry the belt-catching finger 19 pivotally thereon. The finger 19 includes a T-shape key-securing member 20, comprising a leg 21 and a flat sleeve 22 which forms the cross-leg of T-shaped member 20. Member 20 is pivotally engaged centrally on the transverse pin 12, through a transverse bore 23 within leg 21. Leg 21 freely rotates in the conventional cut-out of the belt 16 at its looped end. Sleeve 22 overlies pin 12, is open at both ends, which lie in planes parallel to pin 12. Sleeve 22 has a rectangular shape with its longitudinal axis generally parallel to pin 12. The finger 19 also includes a removable lock key 24, including a flat key head 25 and a stem with an edge portion formed with notches 26 to act as a key to actuate a key lock.

Flat key head 25 is adjustably engaged within sleeve 22, and its stem is aligned longitudinally of and between lateral portions 13, 14 to conventionally engage into a selected hole or aperture in the free end portion of belt 16. The exposed wall of the casing head 22 includes transverse threaded bores 27, 28, into which may engage set screws 29 to firmly immobilize the key in adjusted head 25 within position sleeve 22.

The transverse frame portion 15 is formed with an indentation 30 at its middle to provide a recess in the exterior face of the frame for the free outer end of the stem of key 24.

The U-shape frame member 11 surrounds a space defining a passage for the end of the belt 16. It must be noted that key 24 is readily removable to be replaced whenever desired. In the embodiment of the invention shown in the drawings, the lock key 24 is a standard key, and it is indeed a major goal of the invention to provide a key buckle which can handle a wide variety of non-modified keys having flat key heads 25 and/or stems of various sizes, shapes and thicknesses.

What we claim is:

1. A belt buckle comprising an open frame including a pair of opposite lateral frame portions and a pair of opposite transverse frame portions peripherally extending around the central belt passage, one of said transverse frame portions adapted to be attached to one end of a belt, a lock key-securing member mounted for rotation about said one transverse fame portion, said key-securing member having a T-shape and including a leg and a flat sleeve forming the cross-leg of said T-shaped member, said leg having a transverse bore receiving said one transverse frame portion, said sleeve overlying said one transverse frame portion, being open at both ends, said ends lying in planes parallel to said one transverse frame portion, said sleeve having a rectangular shape with its longitudinal axis generally parallel to said one transverse frame portion, said belt adapted to be used in association with a lock key of the type having a head and a notched stem for actuating a key-actuated lock, said sleeve adapted to receive the head of said key, and further including means carried by said sleeve for adjustably securing said head of said key within said sleeve, with the outer end of the stem of said key adapted to abut against said other transverse portion.

* * * * *